US006857731B2

(12) United States Patent
Tham

(10) Patent No.: US 6,857,731 B2
(45) Date of Patent: Feb. 22, 2005

(54) INK LEVEL INDICATOR AND INK CARTRIDGE HAVING THE SAME

(75) Inventor: Hing Ching Tham, Singapore (SG)

(73) Assignee: Hewlett-Packard Development Company, LP., Houston, TX (US)

( * ) Notice: Subject to any disclaimer, the term of this patent is extended or adjusted under 35 U.S.C. 154(b) by 10 days.

(21) Appl. No.: 10/119,667

(22) Filed: Apr. 10, 2002

(65) Prior Publication Data

US 2003/0193552 A1 Oct. 16, 2003

(51) Int. Cl.[7] ..... B41J 2/175
(52) U.S. Cl. ..... 347/86
(58) Field of Search ..... 347/86, 7, 87, 347/85; 116/276; 222/154–158

(56) References Cited

U.S. PATENT DOCUMENTS 5,079,570 A * 1/1992 Mohr et al. ..... 347/7
5,652,610 A * 7/1997 Kawai et al. ..... 347/87
6,367,919 B1 * 4/2002 Taylor et al. ..... 347/86
6,457,793 B1 * 10/2002 Su ..... 347/7

FOREIGN PATENT DOCUMENTS

JP 4-224771 * 4/1992 ..... B41J/2/175
JP 406099585 A * 4/1994 ..... B41J/2/175

* cited by examiner

*Primary Examiner*—K. Feggins

(57) ABSTRACT

An ink cartridge with ink level indication for containing dispensable ink is disclosed. The ink cartridge includes a cartridge body and a reservoir for receiving and storing ink within the cartridge body. The reservoir is filled with a porous material member. A window is supported by the cartridge body to be disposed adjacent the porous material member. The window interacts with the porous material member to define porous material member portions of predetermined increasing capillarities. Each portion is able to retain ink therein for viewing through the window depending on its capillarity and the amount of ink in the reservoir to thereby provide an overall indication of the amount of ink in the print cartridge.

22 Claims, 4 Drawing Sheets

INK LEVEL INDICATOR AND INK CARTRIDGE HAVING THE SAME

BACKGROUND

This invention relates generally to an ink level indicator and an ink cartridge having the same and, more particularly, to ink level indicator for use in a vented foam-filled ink jet print cartridge having a window for residual ink level indication.

The problem of monitoring the ink volume or ink level in all types of ink-jet printers with ink reservoirs has been variously addressed. So-called backpressure indicators require a plurality of complex seals within the ink cartridge assembly and are therefore relatively expensive and tend to be unreliable. Other ink volume indicators rely on a system that measures the ink bulk electrical conductivity. The electrical conductivity of ink is difficult to control and there is likelihood that future ink improvements could make such a system obsolete.

There have also been attempts in systems to count the "dots" or ink drops dispensed from an ink jet print cartridge. The counters, actuators and sensors needed for such systems may cause the systems to be relatively expensive to build. Furthermore, accuracy may be compromised by the need to assume an average drop volume for all print cartridges. Interruptions such as caused by removal of a print cartridge from a printer or shut-down of the printer are a possible further source of unreliability since the record of the number of drops dispensed from the ink jet print cartridge since the last update is likely to be lost.

SUMMARY

According to an aspect of the present invention, there is provided an ink cartridge for containing dispensable ink. The ink cartridge includes a cartridge body and a reservoir for receiving and storing ink within the cartridge body. The reservoir is filled with a porous material member. A window is supported by the cartridge body to be disposed adjacent the porous material member. The window interacts with the porous material member to define porous material member portions of predetermined increasing capillarities. Each portion is able to retain ink therein for viewing through the window depending on its capillarity and the amount of ink in the reservoir to thereby provide an overall indication of the amount of ink.

According to another aspect of the present invention, there is provided an indicator for indicating the amount of residual ink in a reservoir of an ink cartridge. The indicator includes a foam member in the reservoir and a window disposed against the foam member to define foam member portions that have predetermined varying capillarities. Each of the foam member portions is able to retain a different amount of ink therein for a particular amount of residual ink in the reservoir to appear different from the other foam member portions. The foam member portions when viewed through the window thus provide an indication of the particular amount of residual ink in the reservoir.

BRIEF DESCRIPTION OF DRAWINGS

The invention will be better understood with reference to the drawings, in which.

DETAILED DESCRIPTION

Hereafter, preferred embodiments of the present invention will be described in the context of an ink jet print cartridge. However, it is to be understood that the invention is usable with any type of ink cartridge having a reservoir that is filled with a porous material member.

Figure 1:
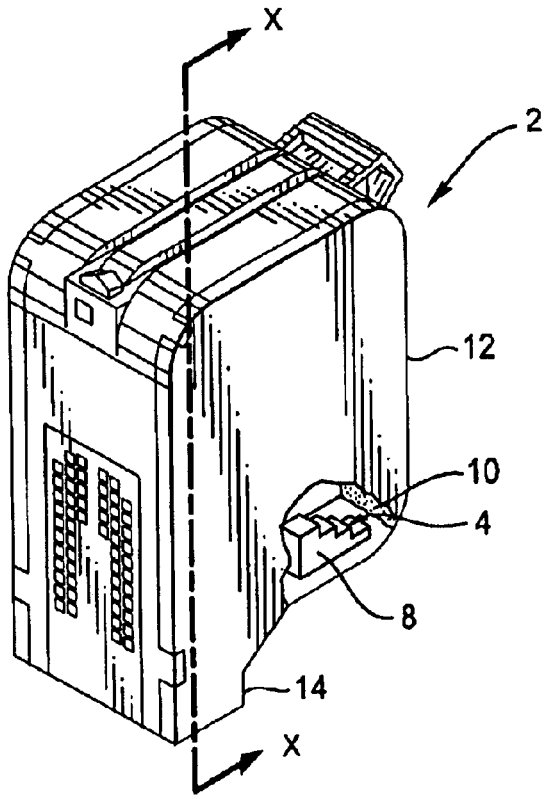
FIG. 1 is an isometric drawing of a multi-chamber vented foam-filled ink jet print cartridge having a wall cut away to show an ink level indicator according to a first embodiment of the present invention.
Figure 3:
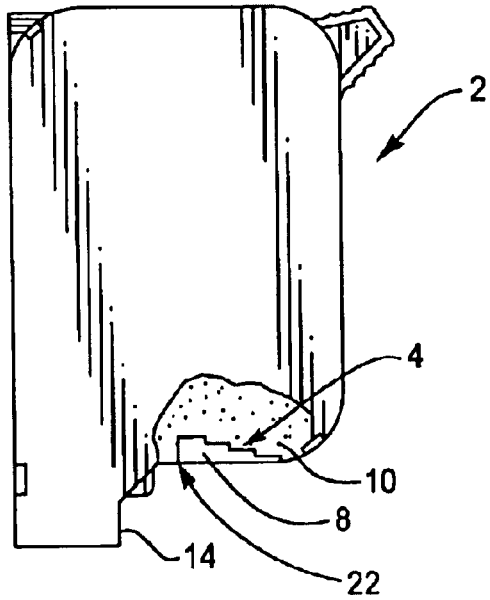
FIG. 3 is a side elevation drawing of the print cartridge in FIG. 1.
Figure 2:
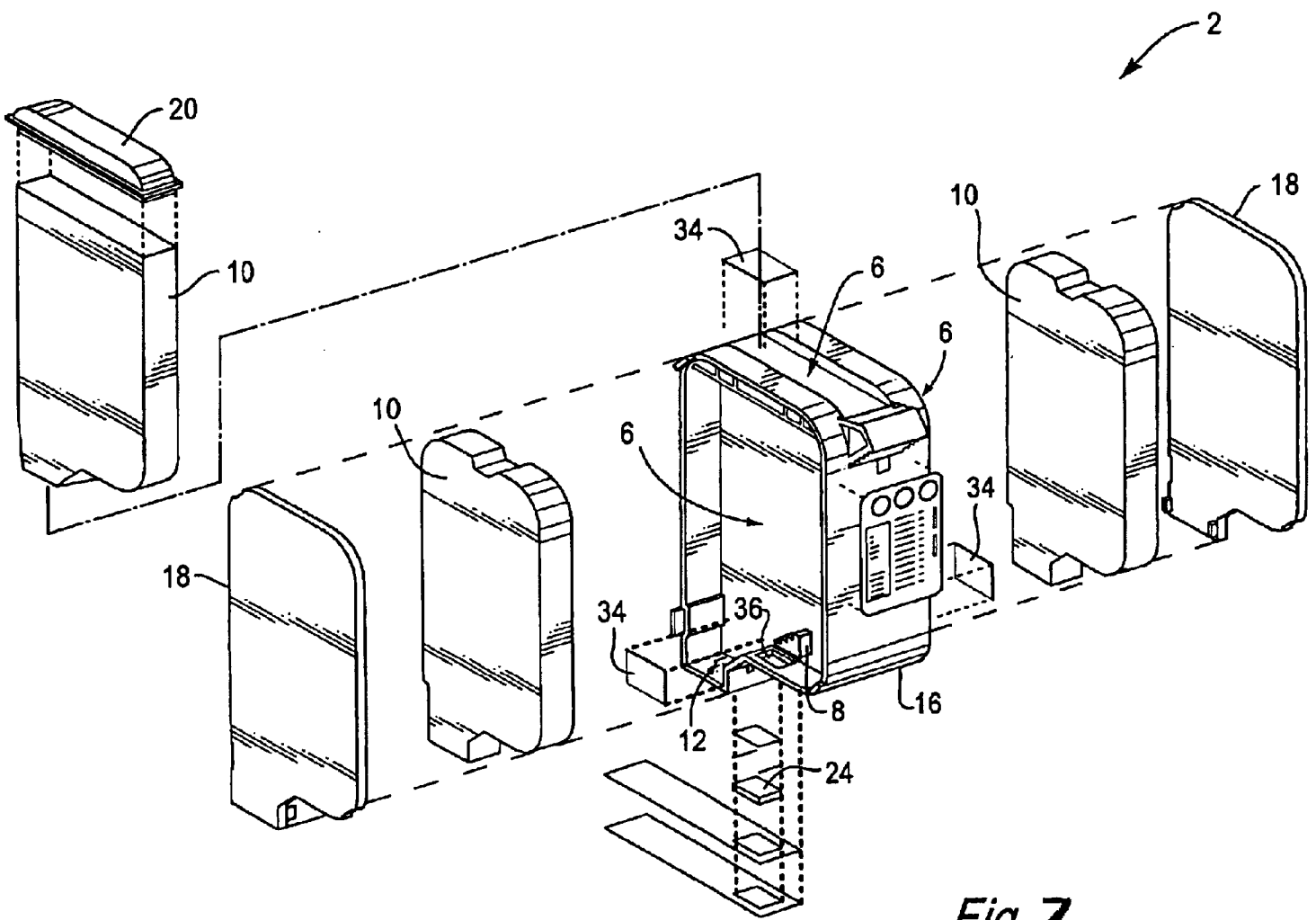
FIG. 2 is a perspective drawing showing a bottom plan view of the ink jet print cartridge in FIG. 1.
Figure 4:
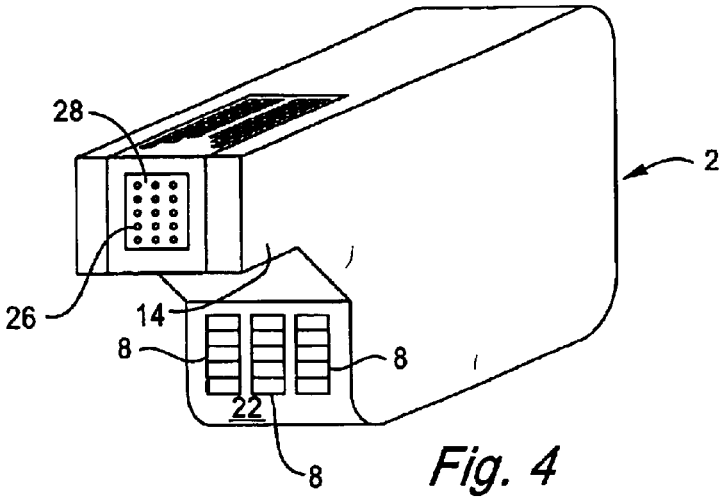
FIG. 4 is an isometric exploded drawing of the print cartridge in FIG. 1.

FIG. 1 shows an isometric drawing of a multi-chamber ink jet print cartridge 2 having a wall cut away to reveal one of three ink level indicators 4 according to a first embodiment of the present invention. The print cartridge 2 has three separate chambers or reservoirs 6 (FIG. 4) for containing three hues of ink. Each of the ink level indicators 4 includes a window 8 that interacts with a porous material member, such as a synthetic foam member 10, in the respective reservoir 6 to indicate to a user the amount of ink residual in the reservoir 6. The window 8 is disposed on the print cartridge 2 to allow a user to view through the window 8 when light falls on the window 8 as shown in FIG. 2. FIG. 3 is a side elevation of the print cartridge 2 having a wall cut away to show one of the ink level indicators 4. FIG. 4 is an exploded drawing of the print cartridge.

According to one embodiment of the present invention, a window 8*a* has steps 38*a*–38*e* (FIG. 5A) of varying thickness. This window 8*a* when disposed or pressed against a foam member 10*a* compresses the foam member 10*a* by varying amounts to result in foam member sections 36*a*–36*e* of varying capillarities adjacent the window 8*a*. Each of the foam member portions 36*a*–36*e* is able to retain a different amount of ink therein for a particular amount of residual ink in a reservoir 6. Each of the foam member portions 36*a*–36*e* thus appears different from the other foam member portions when viewed through the window to provide an indication of the particular amount of residual ink.

The print cartridge 2 includes a body 12 having a snout portion 14. The body 12 includes a main body member 16, two side covers 18 and a center cover 20 (FIG. 4). The main body member 16 has a bottom wall 22 adjacent the snout portion 14. The snout portion 14 supports a printhead 24 having an orifice plate 26 (FIG. 2) that functions as an ink dispensing outlet. Formed in the orifice plate 26 are separate groups of nozzles 28 for ejecting droplets of ink of one of the hues. Ink of each hue is ducted to its respective group of nozzles 28 through an ink pipe or standpipe (not shown) so that the inks do not mix within the print cartridge 2. The foam member 10 in each reservoir 6 receives and retains the ink at an appropriate backpressure by capillary action. Information regarding structural details, operation and the method of manufacturing a print cartridge such as indicated by the reference numeral 2 is disclosed in U.S. Pat. No. 6,042,225.

One of the ink level indicators 4 is described in more details next with the aid of FIGS. 5A–9B. The window 8 of the ink level indicator 4 may be transparent or translucent. The window 8 may be integrally molded with the main body member 16. Alternatively, the window 8 may be a separate plastic panel that is attached to the main body member 16 to cover an aperture 36 in the bottom wall 22 of the main body member 16. Gluing, ultrasonic welding or other methods may be used to attach the window 8 to the main body member 16. In an assembled print cartridge 2, the window 8 is disposed adjacent the foam member 10 to interact with the foam member 10 by pressing against the foam member 10 to define foam member portions 36*a*–36*d* (FIG. 5B) of predetermined increasing capillarities. Depending on the amount of ink in the reservoir 6 and the capillarities of the foam member portions 36*a*–36*d*, each portion 36*a*–36*d* is able to retain ink therein for viewing through the window 8 to thereby provide an overall indication of the amount of ink residual in the reservoir 6.

Figure 5A:
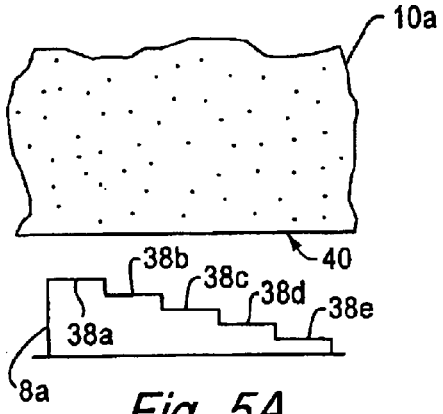
FIGS. 5A and 5B are schematic drawings of the ink level indicator in FIG. 1 showing a window of stepped thickness and a foam member, prior to and after assembly in the print cartridge in FIG. 1 respectively.

The interaction of the window 8 with the foam member 10 may be achieved in any one of several ways. One of these ways includes having a window 8 whose thickness increases in steps of for example 0.75 mm as shown in FIG. 5A. The window 8 may have a plurality of such steps, preferably more than three steps. FIG. 5A shows the window 8*a* with five steps 38*a*–38*e* and the foam member 10*a* having a substantially flat section 40 disposed opposite the steps 38*a*–38*e* of the window 8*a*. The difference in height between steps may be changed depending on the type and felting of the foam member 10*a* and the type of ink.

Figure 5B:
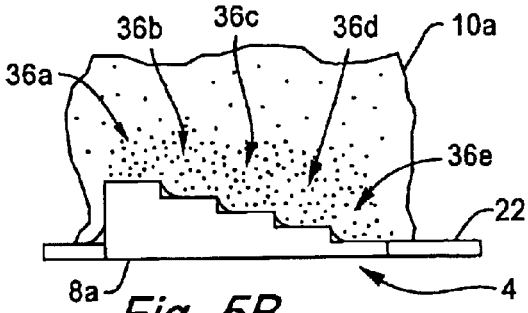

The window 8*a* is brought into compressive contact with the section 40 of the foam member 10*a* as shown in FIG. 5B during assembly of the print cartridge 2. Since the window 8*a* is of non-uniform thickness, the window 8*a* compresses the section 40 of the foam member 10*a* by different amounts to define the foam member portions 36*a*–36*e* that are of different capillarities. The window 8*a* is thickest at the step 38*a*. The portion 36*a* of the foam member 10*a* adjacent the step 38*a* is therefore compressed most to have the highest capillarity. The window 8*a* at step 38*e* is thinnest and the portion 36*e* of the foam member 10 adjacent the step 38*d* may be compressed least to have the lowest capillarity. Alternatively, the step 36*e* may be flush with the inner surface of the bottom wall 22 as shown in FIG. 5B such that the step 36*e* does not additionally compress the felted foam member 10*a*. The portions 36*b*–36*d* of the foam member 10 in between the portions 36*a* and 36*e* have intermediate capillarities. In such an implementation, the capillarity of the foam member portions 36*a*–36*d* changes in substantially distinct steps. Preferably, the foam portion 36*a* with the highest capillarity is disposed closest to the snout portion 14.

Figure 6A:
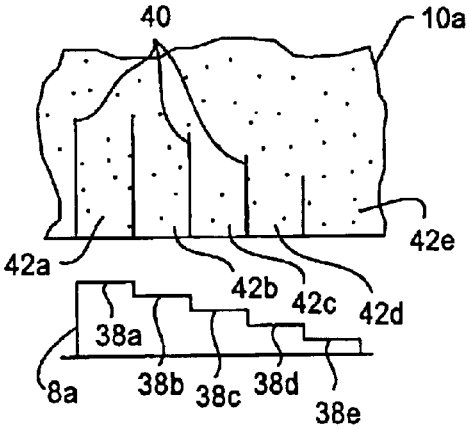
FIGS. 6A and 6B are similar to FIGS. 5A and 5B with slits cut in the foam member to correspond with steps in the window.
Figure 6B:
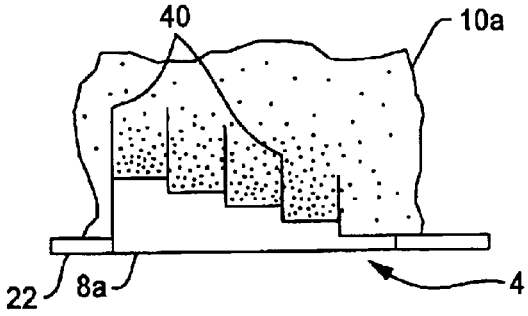

To further enhance the distinctiveness of each of these foam portions 36*a*–36*e*, slits 40 are formed in the foam member prior to assembly to define a plurality of distinct foam member portions 42*a*–42*e* that correspond to the steps 38*a*–38*e* as shown in FIG. 6A. When pressed against the window 8*a*, the foam member portions 42*a*–42*e* facilitate substantially independent compression of each of the plurality of portions 42*a*–42*e* to produce more clearly demarcated compressed foam portions 42*a*–42*e* with different capillarities as shown in FIG. 6B. The operation of this ink level indicator 4 will be described later.

Figure 7A:
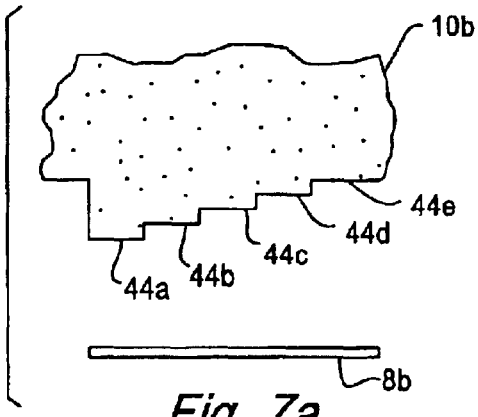
FIGS. 7A and 7B are schematic drawings of an ink level indicator according to a second embodiment of the present invention, showing a flat window and a foam member having a stepped protrusion, prior to and after assembly.
Figure 7B:
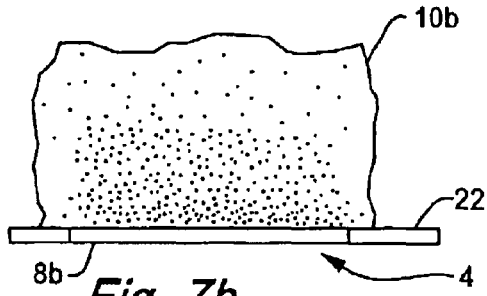

Another way of achieving the foam portions of different capillarities is to have a foam member adjacent the window formed to be differentially compressed by a substantially flat window. For example, a foam member 10*b* may be formed to include a stepped plurality of portions 44*a*–44*e* for pressing against a flat window 8*b* as shown in FIG. 7A. FIG. 7B shows the result of pressing the window 8*b* and the foam member 10*b* together in an assembled print cartridge 2. The interaction of the flat window 8*b* and the foam member 10*b* results in the portions 44*a*–44*e* being differentially compressed. These compressed portions 44*a*–44*e* are similar to those in FIG. 5B.

Figure 8A:
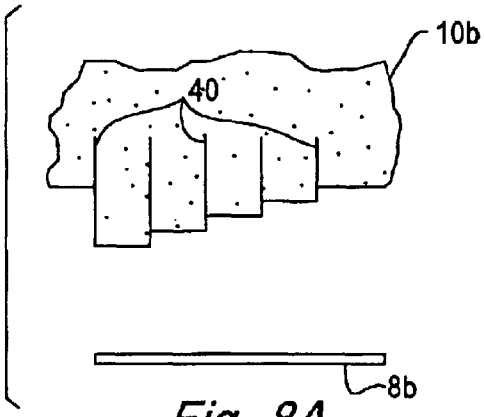
FIGS. 8A and 8B are similar to FIGS. 7A and 7B with slits cut in the foam to allow portions of the foam member to be independently compressed.
Figure 8B:
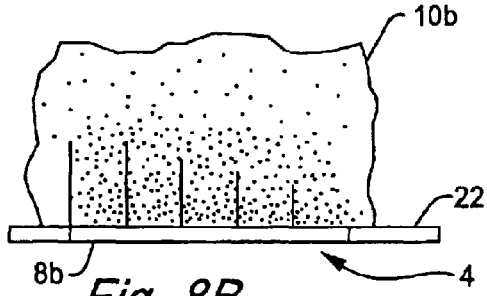

Similarly slits 40 may be foamed in the foam member 10*b*, as shown in FIGS. 8A, to achieve distinct compressed foam portions, as shown in FIG. 8B. The compressed foam portions are similar to those discussed earlier with reference to FIGS. 6A and 6B.

Figure 9A:
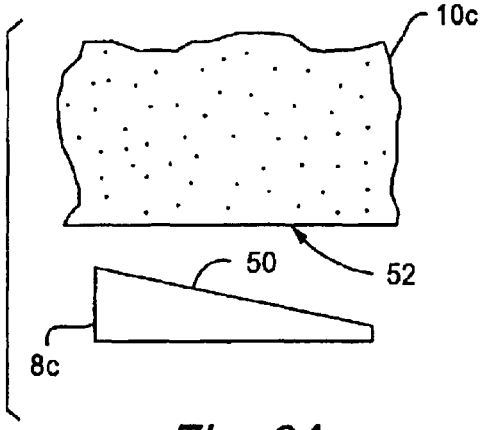
FIGS. 9A and 9B are similar to FIGS. 5A and 5B an ink level indicator according to a third embodiment of the present invention.
Figure 9B:
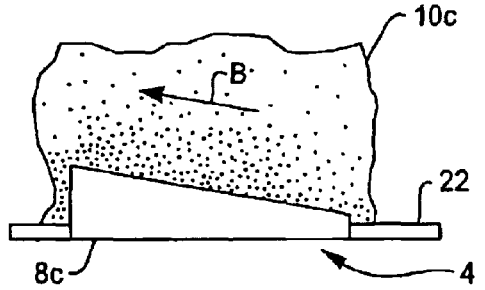

The distinct steps in capillarity in the compressed state of the foam member as shown in FIGS. 5A–8B may be replaced with a foam member that is compressed to define a section of the foam member with a capillarity that increases gradually. FIG. 9A shows a wedge-shaped window 8*c* with an inclined surface 50 disposed opposite a substantially flat section 52 of a foam member 10*c*. When the inclined surface 50 of the window 8*c* is pressed against the section 52 of the foam member, the capillarity of a portion of the pressed section of the foam member 10*c* is changed by an amount corresponding to the thickness of the window immediately adjacent the portion. The section 52 is therefore compressed to have a capillarity that increases in the direction of an arrow B in FIG. 9B. Such gradual increase in capillarity is achievable with a flat window pressing against a protruding wedged portion of a foam member in a manner similar to that shown in FIGS. 7A–8B.

The operation of the ink level indicator 4 in FIG. 6B is described next. When the reservoir 6 is fully filled with ink, the foam member portions 42*a*–42*e* will all be saturated with ink. When viewed from the outside of the window 8*a*, the foam member portions 42*a*–42*e* appear to be dark. The original color of the foam member is not easily discernible. The saturated foam portion members 42*a*–42*e* indicate that the reservoir is in a "full" or near full condition. When ink is dispensed such that the reservoir 6 is for example about "half full", the foam member portions 42*a* and 42*b* may appear through the window steps 38*a* and 38*b* to be dark whereas the other foam member portions 42*c*–42*e* appear lighter, with 42*e* appearing lightest. Foam member portion 42*e* may even hold little or no ink so that the color of the foam member 10*a* is more clearly discernible. When the reservoir 6 is empty or near empty, the foam member portions 42*a*–42*e* may all hold little or no ink such that they all appear light through the window 8*a*. As ink is being dispensed from the print cartridge 2 from full to empty condition, there will be lesser and lesser ink remaining in the reservoir 6. Ink retained in the foam member portions 42*a*–42*e* with lower capillarity will be brought by capillary action to the snout portion 14 to be dispensed first. In this manner, one by one the foam member portions 42*a*–42*e* transform from being dark to become lighter as ink is dispensed to thereby give an indication of how much ink is left in the reservoir. As ink is drawn away from the foam member portions 42*a*–42*e*, the color of the foam member 10*a* becomes more discernible through the window 8*a*. It can be designed such that when the print cartridge 2 is no longer able to dispense any more ink, only the foam member portion 42*a* appears dark. Alternatively, all foam portion members 42*a*–42*e* may become non-saturated to appear light to indicate that the reservoir is "empty" or near empty. In such an implementation, color codes on an outside surface of the print cartridge may be provided to aid a user in distinguishing conditions between a "full" and an "empty" condition of the reservoir 6. The other embodiments in FIGS. 5B, 7B–9B operate in the same manner.

Advantageously, the above described ink level indicator 4 according to the various embodiments of the present invention provide a low cost and reliable solution to existing vented foam-filled ink jet print cartridges for indicating the amount of residual ink therein.

Although the present invention is described according to the different embodiments above, it should not be construed to be limited as such. For example, the invention may be implemented in any foam-filled ink cartridge used for other imprinting apparatus.

As another example, the window 8 which is described in the embodiments as located on a bottom wall 22 of the print cartridge 2 may also be located elsewhere on the print cartridge 2. The window 8 may be located any where on the print cartridge 2 so long as the foam member portions do not become prematurely non-saturated and appears lighter to indicate an empty condition. As such, the window should ideally be located close to the snout portion of the print cartridge where ink is drawn thereto even when the reservoir is near empty.

As yet another example, the thickest step 38*a* of the window in 'FIG. 5A may also be located furthest away from the snout region 14 while the thinnest step 38*e* is located closest to the snout region 14.

As a further example, optical sensor(s) may be used with one or more of the steps 38*a*–38*e* to detect the saturation levels of corresponding foam member portions 42*a*–42*e* by means of a change in reflectivity of these portions.

I claim:

1. An ink cartridge for containing dispensable ink comprising:

a cartridge body;

a reservoir for receiving and storing ink within the cartridge body;

a porous member in the reservoir, the porous member being made of a porous material that can retain ink; and a window supported by the cartridge body for viewing the amount of ink in the reservoir, the window being disposed adjacent the porous member and configured so as to define porous material portions of predetermined increasing capillarity in the porous member, wherein each porous material portion is able to retain ink therein based on its capillarity, and the amount of ink retained by the porous material portions can be viewed through the window.

2. An ink cartridge according to claim 1, wherein the capillarity of the porous material portions increases in distinct steps.

3. An ink cartridge according to claim 2, wherein the porous member has a substantially flat section and the window has a stepped surface that is pressed against the substantially flat section of the porous member for differentially compressing the substantially flat section to define the porous material portions of predetermined increasing capillarity.

4. An ink cartridge according to claim 3, wherein slits are formed in the substantially flat section of the porous material member to correspond to steps of the window to facilitate substantially independent compression by stepped window.

5. An ink cartridge according to claim 2, wherein the window has a flat surface and the porous member adjacent the window is formed to include a stepped plurality of portions that is differentially compressed by the a flat surface of the window.

6. An ink cartridge according to claim 5, wherein slits are formed between adjacent portions of the stepped plurality of portions to facilitate substantially independent compression by the flat surface of the window.

7. An ink cartridge according to claim 1, wherein the capillarity of the porous material portions increases gradually.

8. An ink cartridge according to claim 7, wherein the porous member has a substantially flat section and the window has an inclined surface for differentially compressing the substantially flat section of the porous member.

9. An ink cartridge according to claim 7, wherein the window has a flat surface and the porous member adjacent the window is formed to include an inclined portion to be differentially compressed by the a flat surface of the window.

10. An ink cartridge according to claim 1, wherein the window is located adjacent an ink dispensing outlet of the cartridge body.

11. An ink cartridge according to claim 10, wherein the porous member portion with the highest capillarity is closest to the ink dispensing outlet.

12. An ink cartridge according to claim 10, wherein the window is located on a bottom wall of the ink cartridge adjacent the ink dispensing outlet of the print cartridge.

13. An ink cartridge according to claim 10, wherein the ink cartridge is an ink jet print cartridge and wherein the ink dispensing outlet is located at a snout portion of the cartridge body.

14. An ink cartridge according to claim 1, wherein the window is made of a transparent or translucent material.

15. An ink level indicator for indicating the amount of residual ink in a reservoir of an ink cartridge, the indicator comprising:

a foam member for retaining ink in the reservoir; and a window pressed against the foam member and configured to define foam portions that have predetermined varying capillarity, each of the foam portions being able to retain a different amount of ink therein wherein the amount of ink retained by the foam portions can be viewed through the window.

16. An ink level indicator according to claim 15, wherein the capillarity of the foam portions increases in distinct steps.

17. An ink level indicator according to claim 16, wherein the foam member has a substantially flat section and the window has a stepped surface that is pressed against the substantially flat section for differentially compressing the substantially flat section to define the foam portions that have predetermined varying capillarity.

18. An ink level indicator according to claim 17, wherein slits are formed in the substantially flat section of the foam member to correspond to steps of the window to facilitate substantially independent compression by stepped window.

19. An ink level indicator according to claim 16, wherein the window has a flat surface and the foam member adjacent the window is formed to include a stepped plurality of portions to be compressed by the flat surface of the window.

20. An ink level indicator according to claim 19, wherein the capillarity of the foam portions increases gradually.

21. An ink level indicator according to claim 20, wherein the window has an inclined surface for differentially compressing a substantially flat section of the foam member.

22. An ink level indicator according to 15, wherein the window is made of a transparent or translucent material.

* * * * *